United States Patent [19]

Sokai et al.

[11] Patent Number: 5,003,277

[45] Date of Patent: Mar. 26, 1991

[54] PHASE-SHIFTING TRANSFORMER WITH A SIX-PHASE CORE

[75] Inventors: Katsuji Sokai; Koichi Ishii, both of Ako, Japan

[73] Assignee: Mitsubishi Denki Kabushiki Kaisha, Japan

[21] Appl. No.: 390,821

[22] Filed: Aug. 8, 1989

[30] Foreign Application Priority Data

Aug. 15, 1988 [JP] Japan ..... 63-201858

[51] Int. Cl.[5] ..... H01F 33/00

[52] U.S. Cl. ..... 336/10; 336/12; 336/181; 336/212; 336/215; 363/160

[58] Field of Search ..... 323/215, 361; 336/5, 336/10, 12, 180, 181, 182, 212, 215; 363/64, 160, 171

[56] References Cited

U.S. PATENT DOCUMENTS 4,488,136 12/1984 Hansen et al. ..... 336/10 X 4,853,664 8/1989 Asakura ..... 336/12

*Primary Examiner*—Thomas J. Kozma

*Attorney, Agent, or Firm*—Leydig, Voit & Mayer

[57] ABSTRACT

A phase-shifting transformer including main and series transformer units comprises a six-phase core including six independent magnetic circuits, numbered first through sixth from right to left. The combined U-, V-, and W-phase windings of the main transformer unit link with the fifth, third, and first magnetic circuits, respectively. The combined a-, b-, and c-phase windings of the series transformer unit link with the sixth, fourth, and second magnetic circuits. The winding directions of the V- and b-phase windings are reversed with respect to those of other phase windings. Thus, if three-phase voltages 120 degrees apart are input to the main transformer unit, then the phase angles between the main magnetic fluxes generated in any two adjacent magnetic circuits are equal to 30 degrees. Consequently, the magnitudes of the differential magnetic fluxes passing through the interphase portions between two adjacent magnetic circuits are reduced to about one half of the magnitudes of the main magnetic fluxes, with the result that the cross-sectional area of the interphase portions of the core can be reduced to about one half of that of its main leg portions.

5 Claims, 5 Drawing Sheets

PHASE-SHIFTING TRANSFORMER WITH A SIX-PHASE CORE

BACKGROUND OF THE INVENTION

This invention relates to phase-shifting (or phase-compensating) transformers that advances or retards the phase-angle relationship of one three-phase circuit with respect to another; more particularly, it relates to such transformers that are used in three-phase power and distribution systems for connecting two power systems which have different voltages and phase angles, or for controlling the power flow in a loop-shaped power system so as to minimize the transmission loss therein.

Phase-shifting (or phase-compensating) transformers are used to adjust the phase angle of an output, controlling the output within specified limits and compensating for the fluctuations of the load and input. Conventional phase-shifting transformers for three-phase power systems have generally comprised two three-phase transformer units whose cores are relatively large-sized and heavy. FIGS. 1 and 2 show, in a perspective view and a plan view thereof respectively, a typical interior structure of the essential portions of one of the two three-phase transformer units of a conventional phase shifting transformer, i.e., the main or the series transformer unit. In order to make clear the above-mentioned disadvantages of the conventional phase-shifting transformers, let us first describe the electrical structure and method of operation of phase-shifting transformers in some detail.

FIG. 3 is a circuit or wiring diagram showing a typical circuit structure of a phase-shifting transformer. The phase-shifting transformer consists of two three-phase transformer units: a main transformer unit 1 and a series transformer unit 11, each of which constitutes a three-phase transformer, a typical interior structure of which is as shown essentially in FIGS. 1 and 2. Thus, the main and the series transformer unit 1 and 11 each comprise windings which are wound on a three-phase core (i.e. a core having three independent magnetic circuits each linking with one of the three phases of the windings of the transformer unit).

The main transformer unit 1 comprises three three-phase windings: a Y-connected primary winding 2, a Y-connected secondary winding 3, and a Δ-connected tertiary winding 4, each one of which comprises three phase-windings: U-phase, V-phase, and W-phase winding. The phase-windings which are in the same phase (i.e. U-, V-, or W-phase) are drawn parallel to each other in the figure and are magnetically coupled to each other via respective magnetic circuits of the core of the main transformer 1. The U-, V-, and W-phase windings of the Y-connected primary winding 2 are provided with input terminals U, V, and W, respectively, which are coupled to a three-phase power source system. On the other hand, the U-, V-, and W-phase windings of the Y-connected secondary winding 3 are provided with output terminals u, v, and w, respectively, that are coupled to the load.

The series transformer unit 11 also comprises three three-phase windings: a Y-connected phase-regulating (or phase-compensating) winding 13, a Y-connected excitation winding 14, and a Δ-connected stabilizing winding 15, each one of which comprises three phase-windings in a-, b-, and c-phase, respectively; the phase-windings in the same phase (i.e., in a-, b-, or c-phase) are drawn parallel to each other in the figure, and are magnetically coupled to each other via respective magnetic circuits of the core of the series transformer 11. The three terminals of the Y-connected excitation winding 14 are coupled, via the terminals a, b, and c, respectively, to the terminals of the Δ-connected tertiary winding of the main transformer unit 1, to be supplied with an exciting current of the series transformer unit 11. On the other hand, the a-, b-, and c-phase windings of the Y-connected phase-regulating winding 13, which comprise change-over taps Ta, Tb, and Tc, and contacts Sa, Sb, and Sc, are coupled, via these taps and contacts, electrically in series with the V-, W-, and U-phase windings, respectively, of the Y-connected secondary winding 3 of the main transformer unit 1, so as to adjust the phase-angle of the output voltages at the terminals u, v, and w of the secondary winding 3 of the main transformer unit 1.

The method of operation of the phase-shifting transformer having a wiring structure as shown in FIG. 3 may now be comprehended easily. When a three-phase power system is coupled to the primary winding 2 of the main transformer unit 1 via the terminals U, V, and W, so that the system or source voltages $E_U$, $E_V$, and $E_W$ are applied on the respective terminals, voltages are induced across the U-, V-, and W-phase winding thereof which counterbalance the system voltages $E_U$, $E_V$, and $E_W$, respectively. Thus, assuming, for simplicity's sake, that the winding directions of the U-, V-, and W-phase windings are the same, magnetic fluxes $\phi_U$, $\phi_V$, and $\phi_W$ whose phases are displaced 120 degrees from each other, as shown in solid arrows in the phasor (or vector) diagram of FIG. 4, are induced in the respective magnetic circuits of the core of the main transformer unit 1. As a result, voltages in phase with the voltages across the phase-windings of the primary winding 2 are induced in the respective phase-windings, drawn parallel thereto, of the Y-connected secondary and the Δ-connected tertiary windings 3 and 4.

Since the tertiary winding 4 is Δ-connected while the primary winding 2 is Y-connected, the voltages $E_A$, $E_B$, and $E_C$, with respect to the ground, at the terminals a, b, and c of the tertiary winding 4 are retarded 30 degrees in their phases with respect to the voltages $E_U$, $E_V$, and $E_W$, with respect to the ground (i.e. the voltage at the neutral point of Y-connection), at the terminals U, V, and W of the primary winding 2. Further, since the excitation winding 14, coupled to the terminals a, b, and c, is Y-connected, the voltages $E_A$, $E_B$, and $E_C$ at the terminals a, b, and c with respect to the ground are applied across the a-, b-, and c-phase windings, respectively, of the excitation winding 14. Hence, the phases of the voltages applied across the a-, b-, and c-phase windings of the excitation winding 14 of the series transformer unit 11 are retarded by 30 degrees with respect to the phases of the voltages across the U-, V-, and W-phase windings of the primary 2, secondary 3, and tertiary winding 4 of the main transformer unit 1.

Now, in order to make the explanation simpler, let us assume that the winding directions of the three phase-windings (i.e. a-, b-, and c-phase windings) of the excitation winding 14 of the series transformer unit 11 are the same. As shown in the phasor or vector diagram of FIG. 5, three magnetic fluxes $\phi a$, $\phi b$, and $\phi c$ (represented by solid arrows), which are displaced 120 degrees from each other and are retarded by 30 degrees with respect to the magnetic fluxes $\phi_U$, $\phi_V$, and $\phi_W$ (represented by broken arrows), respectively, of the main transformer unit 1, are induced in the respective magnetic circuits of the core of the series transformer unit 11 which are linking the a-, b-, and c-phase windings, respectively, of the excitation winding 14. As a result, voltages Ea, Eb, Ec in phase with the voltages across the a-, b-, and c-phase windings of the excitation winding 14 are induced in the a-, b-, and c-phase windings, respectively, of the regulating winding 13 and the stabilizing winding 15, which are drawn parallel thereto and magnetically coupled therewith, respectively.

Thus, the voltages developed across the a-, b-, and c-phase windings of the regulating winding 13, the excitation winding 14, and the stabilizing winding 15 of the series transformer unit 11 are retarded 30 degrees in their phases with respect to the voltages across the U-, V-, and W-phase windings of the windings 2 through 4 of the main transformer unit 1. Consequently, as shown in the phasor diagram of FIG. 6, the voltages Ea, Eb, and Ec induced respectively across the lengths of the a-, b-, and c-phase windings of the phase-regulating winding 13 that are electrically coupled in series with the V-, W-, and U-phase windings of the secondary winding 3 are retarded by 30 degrees with respect to the system voltages $E_U$, $E_V$, and $E_W$(represented by broken arrows in the figure), respectively. Hence, the same voltages Ea, Eb, and Ec developed in the regulating winding 13 are advanced by 90 degrees with respect to the voltages $E_V$, $E_W$, and $E_U$, respectively. Further, as discussed above, the voltages 20, $E_V'$, $E_W'$, $E_U'$ induced across the the V-, W, and V-phase windings of the secondary winding 3 are in phase with the source voltages $E_V$, $E_W$, $E_U$. Thus, the above voltages Ea, Eb, and Ec are advanced by 90 degrees with respect to the voltages $E_V'$, $E_W'$, and $E_U'$ induced across the respective phase windings of the secondary winding 3. Since the a-, b-, and c-phase windings of the regulating winding 13 are electrically coupled in series with the V-, W-, and U-phase windings, respectively, of the secondary winding 3, the voltages Eu, Ev, Ew with respect to the ground at the terminals u, v, and w of the secondary winding 3 are given as vector sums of Ea and $E_V'$, Eb and $E_W'$, and Ec and $E_U'$, respectively, as shown in FIG. 6; namely:

$$Ev = Ea + E_V',$$

$$Ew = Eb + E_W',$$

and $$Eu = Ec + E_U'.$$

As a result, the phases of the voltages Eu, Ev, and Ew with respect to the ground at the output terminals u, v, and w of the secondary winding 3 are advanced or retarded with respected to the system voltages $E_U$, $E_V$, and $E_W$, respectively, by a phase angle $\theta$ the magnitude of which can be adjusted by varying the magnitude of the voltages Ea, Eb, and Ec. Whether the output voltages Eu, Ev, and Ew are advanced or retarded depends on the polarities of the serial connections of the voltages Ea, Eb, and Ec (i.e, on the positions of the contacts Sa, Sb, and Sc). Thus, by adjusting the positions of the contacts Sa, Sb, and Sc and those of the taps Ta, Tb, and Tc by means of an onload tap changer (not shown), the phases of the output voltages Eu, Ev, and Ew of the secondary winding 3 can be adjusted arbitrarily.

In the above discussion of the operation of the phase-shifting transformer having the wiring structure of FIG. 3, it was assumed, for simplicity's sake, that winding directions of the phase-windings 2 through 4 of the main transformer unit 1, or those of the phase-windings 13 through 15 of the series transformer unit 11, are the same. However, as is obvious to those skilled in the art, this assumption is not essential. Although the directions of the magnetic fluxes may be reversed, the relationships of the voltage phasors shown in FIG. 6 hold good irrespective of the winding directions of the respective phase-windings. Hence, the principles of operation are essentially as described above even if the V-phase windings within the main transformer unit 1 or b-phase windings within the series transformer unit 11, for example, are wound in the opposite directions with respect to other phase-windings of the transformer unit 1 or 11.

Referring once again to FIGS. 1 and 2, let us now describe the physical structure of the essential interior portions of the main and the series transformer units 1 and 11. FIGS. 1 and 2 show, in a perspective and a plan view, respectively, the interior of the main transformer unit 1 alone. The series transformer unit 11 has essentially the same interior structure, except that the U-, V-, and W-phase windings of the main transformer unit 1 are replaced by the a-, b-, and c-phase windings, respectively. Thus, in the following, only the structure of the main transformer unit 1 is described in reference to FIGS. 1 and 2; the whole phase-shifting transformer having a wiring structure of FIG. 3 is constituted by two such transformer units electrically coupled to each other according to the wiring structure shown in FIG. 3.

The combined U-, V-, and W-phase winding units 22U, 22V, and 22W, which consist of the combination of U-, V-, and W-phase windings, respectively, of the primary, secondary, and tertiary windings 2 through 4, are wound around respective main leg portions 23 of a core 21; however, the winding direction of the combined V-phase winding 22V is reversed with respect to those of the combined U- and W-phase windings 22U and 22W. Thus, since the figures show a shell-type core structure, the combined U-, V-, and W-phase windings 22U, 22V, and 22W each link with a magnetic circuit consisting of a pair of closed flux paths for passing the main magnetic fluxes $\phi_U$, $-\phi_V$, and $\phi_W$ therethrough, respectively, wherein the flux paths of any two adjacent magnetic circuit have portions 24 (referred to hereinafter as interphase portions) common to both, which are shaded in FIG. 2.

As stated above, the winding direction of the combined V-phase winding 22V is reversed with respect to others. Thus, as shown by a broken arrow in FIG. 4, the main magnetic flux $-\phi_V$, linking with the combined V-phase winding 22V and flowing in the direction as shown by the arrow $-\phi_V$ in FIG. 2, is displaced by a phase angle of 60 degrees with respect to the magnetic fluxes $\phi_U$ and $\phi_W$ linking with combined U- and W-phase windings 22U and 22W, respectively. The absolute magnitudes of these three main magnetic fluxes $\phi_U$, $-\phi_V$, and $\phi_W$ are equal to one another.

Now, let us consider the magnitudes of the differential magnetic fluxes flowing through the interphase portions 24 (shaded in the figure) of the core 21 that are common to the adjacent magnetic circuits for the magnetic fluxes $\phi_U$, $-\phi_V$, and $\phi_W$, respectively, within the core 21. It is easy to see from FIG. 2 that the differential magnetic fluxes passing through the interphase portions 24 of the core 21 are given by a vector difference between two magnetic fluxes flowing through the two adjacent magnetic circuits. Thus, the differential magnetic flux $\phi_{UV}$ passing through the interphase portion 24 between the two magnetic circuits linking respectively with the combined U- and V-phase windings 22U and 22V is given by the vector difference between the two adjacent main magnetic fluxes $\phi_U$ and $-\phi_V$:

$$\phi_{UV}=\phi_U-(-\phi_V).$$

Further, the differential magnetic flux $\phi_{VW}$ passing through the interphase portion 24 between the two magnetic circuits linking respectively with the combined V- and W-phase windings 22V and 22W is given by the vector difference between the two adjacent main magnetic fluxes $-\phi_V$ and $\phi_W$:

$$\phi_{VW}=-\phi_V-\phi_W.$$

The vectorial relationships between these main and differential magnetic fluxes are graphically represented in FIG. 4, wherein the three main magnetic fluxes $\phi_U$, $-\phi_V$ have the same absolute magnitudes and are separated by 60 degrees from each other. Thus, as is apparent from the figure, the absolute magnitudes of the differential magnetic fluxes $\phi_{UV}$ and $\phi_{VW}$ passing through the interphase portions 24 of the core 21 are equal to that of the absolute magnitudes of the main magnetic fluxes $\phi_U$, $-\phi_V$, and $\phi_W$.

The cross-sectional areas of magnetic circuits within a transformer must be sufficiently large to pass therethrough the magnetic fluxes generated therein. Thus, the cross-sectional areas of the interphase portions 24 should be designed equal to those of the main leg portions 23 of the core 21. Since the thickness or height H of the core 21 is uniform, the width $D_2$ of the interphase portions 24 of the core 21 are designed equal to the width $D_1$ of its main leg portions 23. The situation is the same with the series transformer 11 which has fundamentally the same core structure.

Thus, due to the core structure described above, the conventional phase-shifting transformer has the following disadvantages: First, since the transformer is devides into two three-phase transformer units, i.e., the main and the series tranformer units, it is large-sized and requires much time and labor in the assembly, transportion, and installation thereof. In addition, equipment for the transformer, such as tanks, bushings, and protective relays, must be provided separately for the two units. Even if the two transformer units are accomodated in a single tank, the essential interior structure remains the same, with the result that the production cost cannot be materially reduced. The large outer dimension of the tank, however, results in the increased cost in the transportation, etc.

A second disadvantage of the conventional phase-shifting transformer, which is related to the above first disadvantage and makes it even worse, is that the cores of the two transformer units are heavy and large-sized even taken by themselves due to the fact that their interphase portions must have large cross-sectional areas to allow the passage of the differential magnetic fluxes therethrough.

SUMMARY OF THE INVENTION

It is the primary object of this invention therefore to provide a phase-shifting transformer for adjusting the phase-angles of the three-phase voltages of one circuit with respect to those of another, wherein the transformer is small-sized, and thus is inexpensive in the production, transportation and installment thereof.

The above object is accomplished according to the principle of this invention in a phase-shifting transformer which comprises a six-phase magnetic core on which the windings of both the main and the series transformer unit are wound. The six-phase magnetic core includes six mutually independent magnetic circuits, first through sixth from one extreme end to the other of the magnetic core, through which six mutually independent magnetic fluxes may pass. Any two adjacent numbered magnetic circuits of the core are geometrically adjacent to each other, and any two adjacent magnetic circuits each comprise an interphase portion that is common to both magnetic circuits.

The three-phase main transformer windings wound on the six-phase magnetic core includes a three-phase primary winding to which the three-phase input voltages whose phases are displaced by 120 degrees from each other are applied, wherein respective phase-windings of the three-phase main transformer windings link with the first, third, and fifth, respectively, of the six magnetic circuits of said six-phase magnetic core, and are wound in such directions as to generate in the first, third, and fifth magnetic circuits three magnetic fluxes whose phases are separated from each other by 60 degrees.

The three-phase series transformer windings are wound on said six-phase magnetic core and electrically coupled to said main three-phase transformer windings in such a manner that voltages in quadrature with said three-phase input voltages are developed across respective phase-windings of the three-phase series transformer windings, wherein the respective phase-windings of the three-phase series transformer windings link with the second, fourth, and sixth of the six magnetic circuits of said six-phase magentic core to generate therein three magnetic fluxes respectively whose phases are separated by 60 degrees from each other and by 30 degrees from the phases of the magnetic fluxes generated in adjacent magnetic circuits by the three-phase main transformer windings linking with the adjacent magnetic circuits. Thus, the differential magnetic fluxes passing through the interphase portions of said six-phase magnetic core each consist of a vector difference between two magnetic fluxes whose phases are separated by 30 degrees from each other.

More specifically, the three-phase main transformer windings comprise three-phase primary, secondary, and tertiary windings. The three-phase primary winding electrically coupled to the input voltages has three phase-windings linking with the first, third, and fifth, respectively, of the six magnetic circuits of the six-phase magnetic core. The winding direction of the phase-winding linking with the third magnetic circuit is reversed with respect to winding directions of the phase-windings linking with the first and the fifth magnetic circuits. Phases of three magnetic fluxes generated by the three phase-windings of the three-phase primary winding in the first, third, and fifth magnetic circuits, respectively, of the six-phase magnetic core are separated by 60 degrees from each other. The three-phase secondary and tertiary winding has three phase-windings linking with the first, third, and fifth, respectively, of the six magnetic circuits of the six-phase magnetic core, so as to be magnetically coupled with the respective three phase-windings of the three-phase primary winding via the first, third, and fifth magnetic circuits.

The three-phase series transformer windings comprise a three-phase excitation winding and another three-phase winding magnetically coupled therewith. The excitation winding has three phase-windings linking with the second, fourth, and sixth respectively, of the six magnetic circuits of the six-phase magnetic core. Further, the three-phase excitation winding is wound on the magnetic core and electrically coupled to the three-phase tertiary winding in the following manner. First, three-phase voltages in quadrature with the three-phase input voltages are developed across the three phase-windings of the three-phase excitation winding. Second, the phases of three magnetic fluxes generated by the three phase-windings of the three-phase excitation circuit in the second, fourth, and sixth magnetic circuits, respectively, are separated by 60 degrees from each other, and by 30 degrees from the phases of the magnetic fluxes generated by the three phase-windings of the three-phase primary winding in adjacent magnetic circuits. Thus, the differential magnetic fluxes passing through the interphase portions of the six-phase magnetic core each consist of a vector difference between two magnetic fluxes whose phases are separated by 30 degrees from each other. The last-mentioned three-phase winding (which may be the phase-regulating winding) of the series transformer windings has three phase-windings linking with the second, fourth, and six, respectively, of the six magnetic circuits of the six-phase magnetic core; to be magnetically coupled with the respective three phase-windings of the three-phase excitation winding via the second, fourth, and sixth magnetic circuits, respectively. The three phase-windings of this three-phase winding that is magnetically coupled with the three-phase excitation winding are electrially coupled in series with the three phase-windings of the three-phase secondary winding to form the three-phase output voltages whose phase angles are shifted and adjusted with respect to the phase angles of the three-phase input voltages.

Thus, according to this invention, the phase-shifting transformer comprises a single six-phase magnetic core, wherein the phases of the magnetic fluxes flowing in adjacent magnetic circuits are separated by 30 degrees from each other. The absolute values or magnitudes of the differenetial magnetic fluxes passing through the interphase portions are reduced to about one half, as will become clear from the detailed description of the preferred embodiments, compared with the magnitudes of the main magnetic fluxes. The dimensions of the transformer, and hence the cost of its production, transportation, and installment, can therefore be much reduced.

BRIEF DESCRIPTION OF THE DRAWINGS

The novel features which are believed to be characteristic of this invention are set forth with particularity in the appended claims. This invention itself, however, both as to its organization and method of operation, may best be understood by reference to the following description taken in conjuction with the accompanying drawings, in which:

FIGS. 8 and 9 are phasor or vector diagrams showing the vectorial relationships among the magnetic fluxes generated in the magnetic core shown in FIG. 7, wherein FIG. 8 shows the case where the magnitudes of the main magnetic fluxes of the main and the series transformer unit are equal and FIG. 9 shows the case where they are different.

In the drawings, like reference numerals or characters represent like or corresponding parts, dimentions, or phasors (vectors).

DETAILED DESCRIPTION OF THE PREFERRED EMBODIMENT

Figure 3:
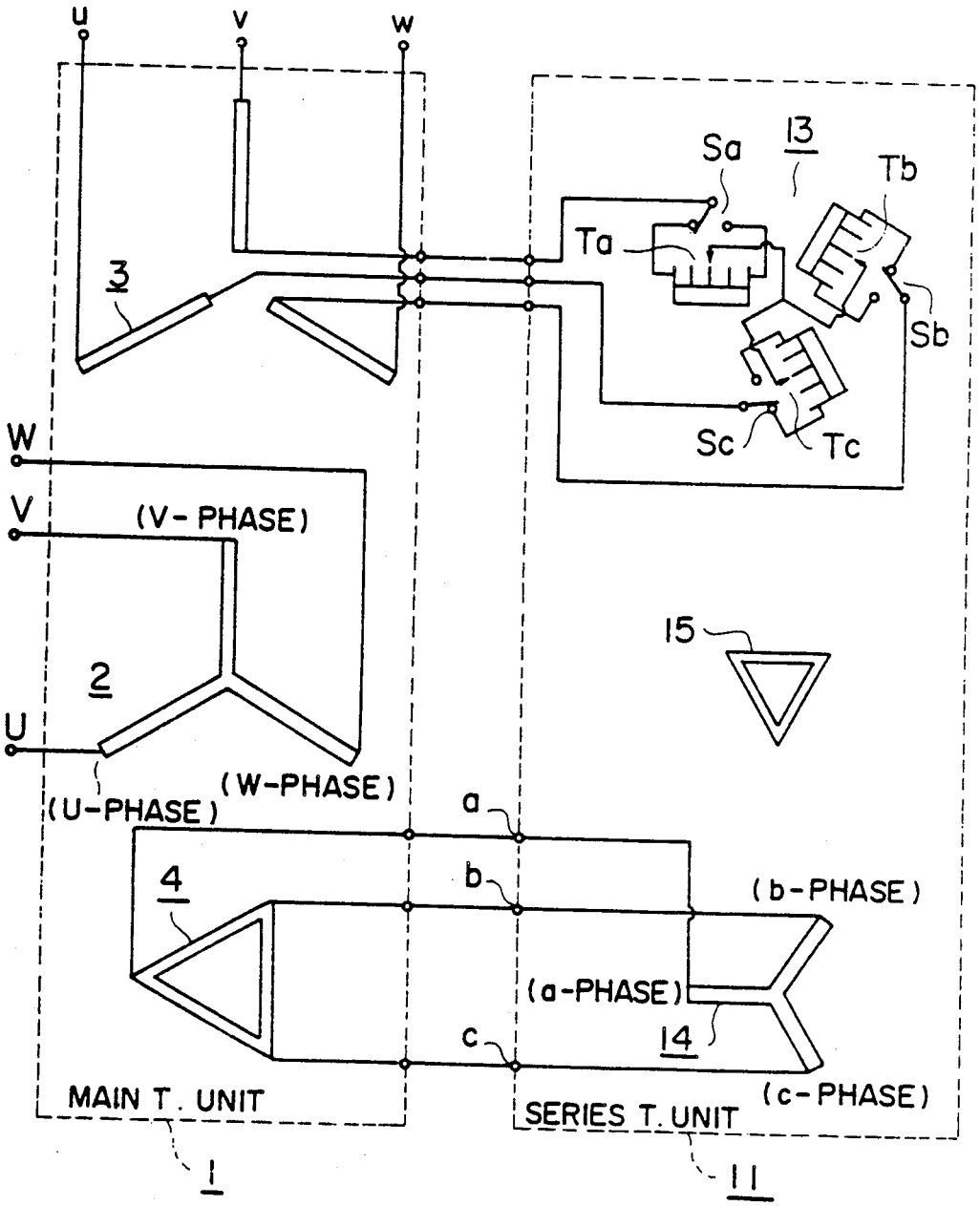
FIG. 3 PRIOR ART
FIG. 3 is a circuit or wiring diagram showing a typical wiring organization of a phase-shifting transformer.
Figure 4:
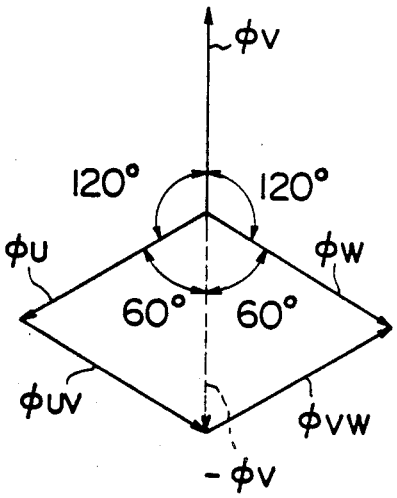
FIG. 4 is a phasor or vector diagram showing the vectorial relationships among the magnetic fluxes generated in the magnetic core of the transformer shown in FIGS. 1 and 2.
Figure 5:
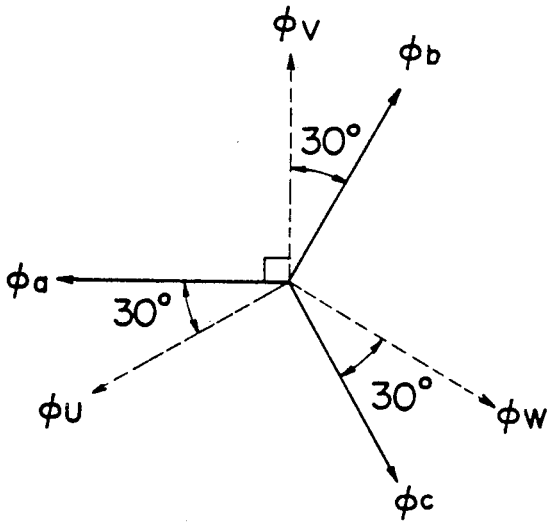
FIG. 5 is another phasor or vector diagram showing the vectorial relationships among the main magnetic fluxes generated in the main and the series transformer unit having a wiring organization shown in FIG. 3.
Figure 6:
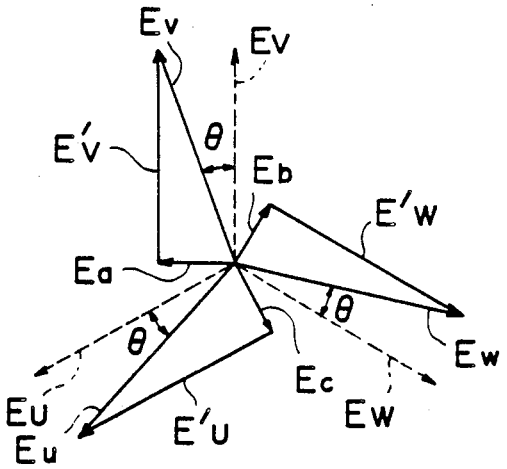
FIG. 6 is a still another phasor or vector diagram showing the vectorial relationships among the voltages applied or induced across the windings of the phase-shifting transformer having a wiring organization shown in FIG. 3.
Figure 7:
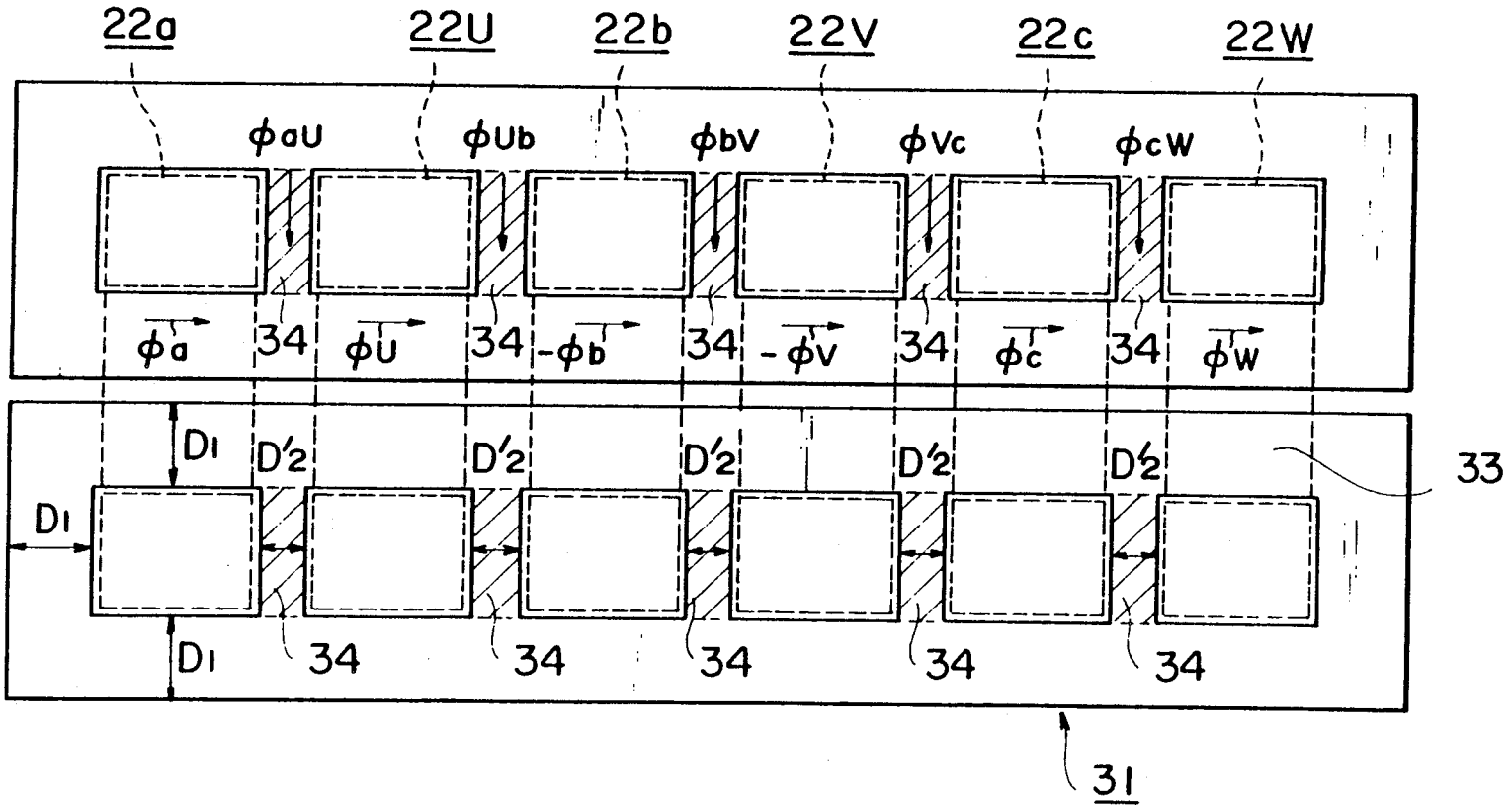
FIG. 7 is a plan view of a six-phase magnetic core of the phase-shifting transformer according to this invention.

Referring now to FIGS. 3 and 7 of the drawings, let us describe an embodiment of the phase-shifting transformer according to this invention. FIG. 7 shows the plan view of a shell-type six-phase core of the phase-shifting transformer according to this invention; the wiring organization of this phase-shifting transformer is as represented in FIG. 3. The wiring organization as represented in FIG. 3 has already been described above, together with the method of phase regulating operation thereof as the explanation of the wiring is not repeated here.

As shown in FIG. 7, the six-phase magnetic core 31 consists of a pair of symmetrically arranged rectangular halves, each consisting of stacked plates of magnetic material and having six rectangular through-holes extending in the direction perpendicular to the surface of the drawing. Thus, the six-phase core 31 comprises six mutually independent magnetic circuits (numbered first through sixth from right to left as viewed in FIG. 7 in accordance with the numbering system as used in the above summary and the appended claims). Each of the six magnetic circuits consists of a pair of flux paths encircling respective through-holes of the core 31. The flux paths of any two adjacent magnetic circuits include interphase portions 34 (shaded in the figure) which are common to and shared by both magnetic circuits. As shown by dotted lines in FIG. 7 the combined phase-windings 22U through 22W of the main transformer unit 1 link with the main leg portions 33 of the fifth, third, and first (the numbering being from right to left as viewed in the figure, as noted above) of the six magnetic circuits of the core 31. The combined phase-windings **22*a* through 22*c* of the series transformer unit 11 link with the main leg portions of the sixth, fourth, and second of the six magnetic circuits of the core 31**.

As explained above in the introductory portion in reference to FIG. 3, the combined U-, V-, and W-phase windings consist of the U-, V-, and W-phase windings, respectively, of the primary, secondary, and tertiary winding 2, 3, and 4 of the main transformer unit 1. The combined a-, b-, and c-phase windings consist of the a-, b-, and c-phase windings, respectively, of the phase-regulating winding 13, excitation winding 14 and stabilizing winding 15 of the series transformer unit 11. The winding direction of the V-phase winding 22V of the main transformer unit 1 and that of the b-phase winding **22*b* of the series transformer unit 11 are reversed with respect to the winding direction of other windings. Thus, as shown in FIG. 7, main magnetic fluxes $\phi_U$, $-\phi_V$, and $\phi_W$ of the main transformer unit 1 whose phases are separated 60 degrees from each other are generated in the magnetic circuits linking with the combined U-, V-, and W-phase windings 22U, 22V, and 22W, respectively. The main magnetic fluxes $\phi a$, $-\phi b$, and $\phi c$ of the series transformer unit 11 are generated in the magnetic circuits linking with the combined a-, b-, and c-phase windings 22*a*, 22*b*, and 22*c*, respectively. The phases of the magnetic fluxes $\phi a$, $-\phi b$, and $\phi c$ are separated by 60 degrees from each other, and by 30 degrees from the phases of the main magnetic fluxes $\phi_U$, $\phi_V$, and $\phi_W$ passing through the respective adjacent magnetic circuits. The vectorial relationships of these magnetic fluxes are as shown in FIG. 8 or 9, in which the magnetic fluxes $\phi_V$ and $\phi b$ are also shown which would be generated if the winding directions of the combined V-phase and b-phase windings 22V and 22*b*** are the same as those of other phase windings.

Let us now evaluate the magnitudes of the differential magnetic fluxes passing through the interphase portions 34 shared by two adjacent magnetic circuits within the core 31. First, consider the differential magnetic flux $\phi a_U$ passing through the interphase portion 34 between the magnetic circuits for passing the magnetic fluxes $\phi a$ and $\phi_U$; as can be easily seen from FIG. 7, this magnetic flux $\phi a_U$ is given by a vector difference between $\phi a$ and $\phi_U$:

$$\phi a_U = \phi_U - \phi a; \tag{1}$$

Figure 8:
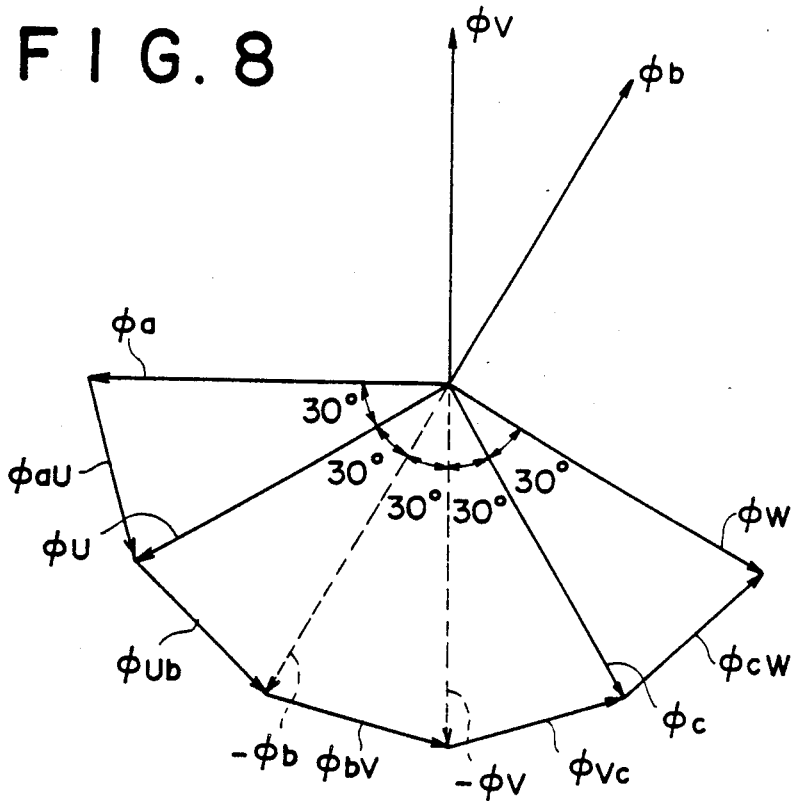
Figure 9:
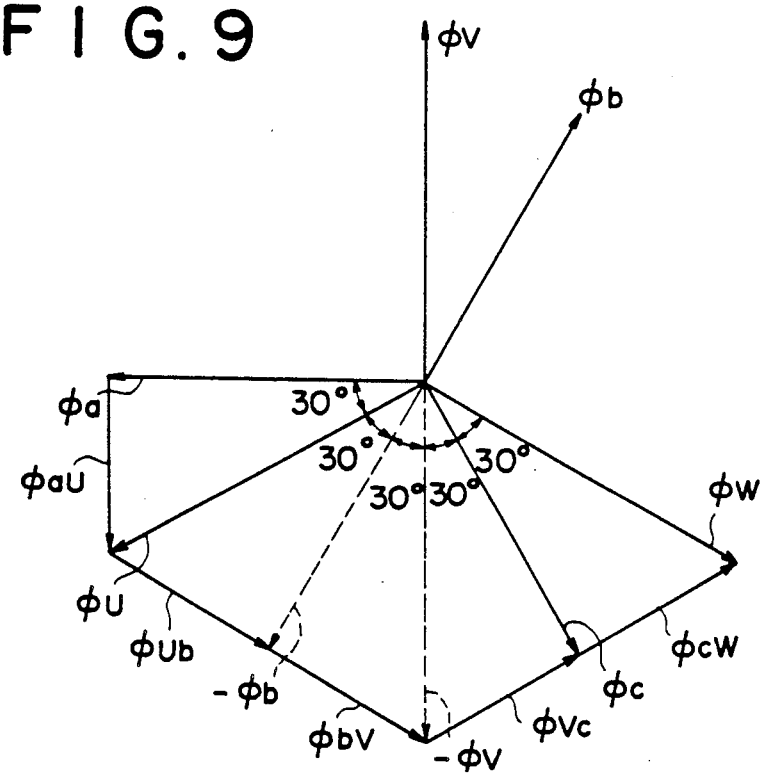

This vector relationship is shown diagrammatically in FIGS. 8 and 9. Similarly, it is easy to perceive from FIG. 7 that the differential magnetic fluxes $\phi_U b$, $\phi b_V$, $\phi_V c$, and $\phi c_W$, passing through the interphase portion 34 between the adjacent magnetic circuits for the magnetic fluxes $\phi U$ and $-\phi b$, that between the magnetic circuits for $-\phi b$ and $-\phi V$, and that between the magnetic circuits for $\phi c$ and $\phi W$, respectively, are given, as represented in FIG. 8 or 9, by:

$$\phi_U b = (-\phi b) - \phi_U, \tag{2}$$

$$\phi b_V = (-\phi_V) - (-\phi b), \tag{3}$$

$$\phi_V c = \phi c - (-\phi_V), \text{ and} \tag{4}$$

$$\phi c_W = \phi_W - \phi c. \tag{5}$$

Now, let us recall that, generally speaking, the absolute value $|X-Y|$ of the vector difference between the two vectors X and Y is given by:

$$|X-Y| = (|X|^2 + |Y|^2 - 2|X| \cdot |Y| \cos \psi)^{\frac{1}{2}} \tag{6}$$

wherein $\psi$ is the angle between the two vectors X and Y. Further, let the absolute values or magnitudes of the main magnetic fluxes of the main transformer unit 1 and the series transformer unit 11 represented by $\phi_M$ and $\phi_S$, respectively, i.e., let $$|\phi_U| = |\phi_V| = |\phi_W| = \phi_M$$

and $$|\phi a| = |\phi b| = |\phi c| = \phi_S.$$

Now, let us first evaluate the absolute values or magnitudes of the differential magnetic fluxes in the case represented in FIG. 8, i.e. in the case where the absolute values or magnitudes $\phi_M$ and $\phi_S$ of the main magnetic fluxes of the main transformer unit 1 and the series transformer unit 11 are equal to each other; namely, $$\phi_M = \phi_S = 1.0\ [P.U].$$

wherein [P.U] designates an arbitrarily chosen base value of the amount of the magnetic flux in the per-unit system. Then, since the phase difference between the magnetic fluxes in adjacent magnetic circuits is 30 degrees, the absolute value or magnitude of the differential magnetic flux $\phi a_U$, for example, is given, from equation (1) and (6) above, by:

$$\begin{aligned} |\phi a_U| &= |\phi_U - \phi a| \\ &= (|\phi_U|^2 + |\phi a|^2 - 2|\phi_U| \cdot |\phi a| \cos 30°)^{\frac{1}{2}} \\ &= (\phi_M^2 + \phi_S^2 - 2\phi_M \phi_S \cos 30°)^{\frac{1}{2}} \\ &= (2 - 3^{\frac{1}{2}})^{\frac{1}{2}} [P.U] \sim 0.52\ [P.U]. \end{aligned}$$

Figure 1:
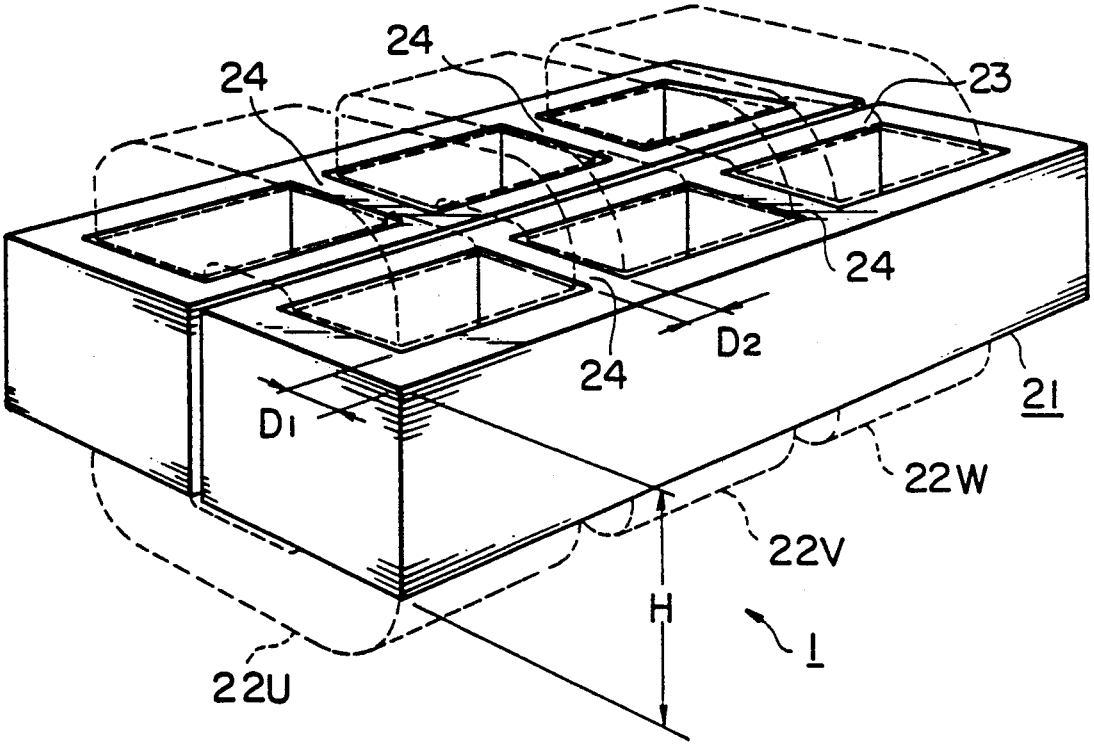
FIG. 1 PRIOR ART
FIG. 1 is a perspective view of the essential interior portions of the main transformer unit of a conventional phase-shifting transformer.
Figure 2:
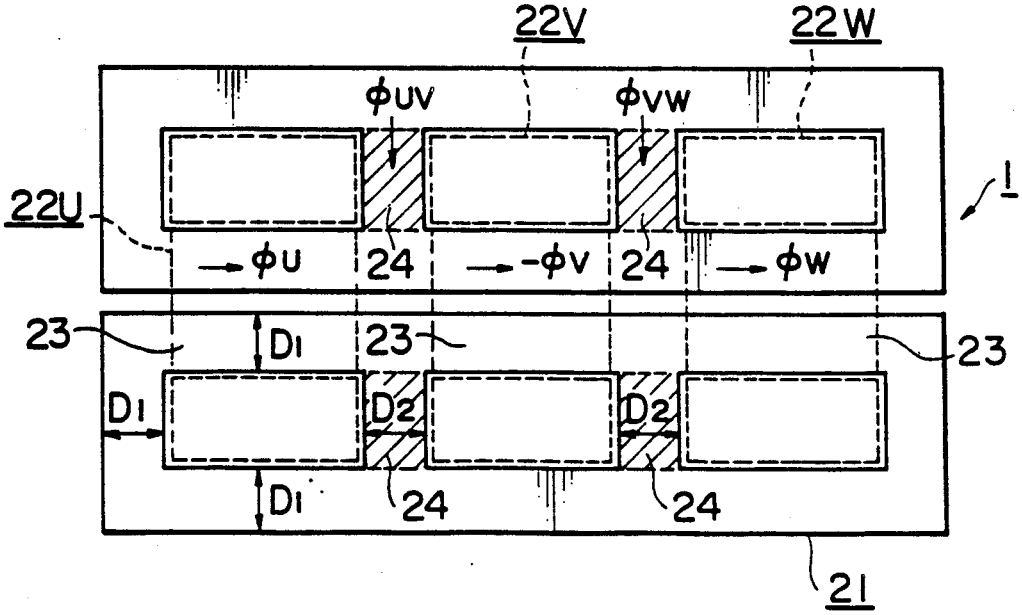
FIG. 2 PRIOR ART
FIG. 2 is a plan view of the same portions of the phase-shifting transformer shown in FIG. 1.

By similar calculations, the absolute values or magnitudes of the differential magnetic fluxes $\phi_U b$, $\phi b_V$, $\phi_V c$, and $\phi c_W$ given by equations (2) through (5) are approximately equal to 0.52 [P.U]. The differential magnetic fluxes $\phi a_U$ through $\phi c_W$ passing through the interphase portions 34 between adjacent magnetic circuits are about 0.52 times the absolute magnitudes of the main magnetic fluxes $\phi a$ through $\phi_W$ passing through the main leg portions 33. As a result, the width $D_2'$ of the interphase portions 34 can be reduced to about one half of the width $D_1$ of the main leg portions 33 of the core 31. Thus, provided that the thickness or height of the six-phase core 31 is equal to the above-mentioned height H of the conventional phase-shifting transformer of FIGS. 1 and 2, the width $D_2'$ of the interphase portion 34 can be reduced to about one half of the above width $D_2$ of the interphase portions 24 of the same conventional transformer.

Let us now evaluate the absolute values or magnitudes of the differential magnetic fluxes in the case where the absolute values or magnitudes $\phi_M$ and $\phi_S$ of the main magnetic fluxes of the main transformer unit 1 and the series transformer unit 11 are different from each other; Let us take the case where $$\phi_M = \phi_S \cdot \cos 30°$$

or $$\phi_S = \phi_M \cdot \cos 30°$$

holds. The magnitudes of the respective differential magnetic fluxes are equal to 0.5 times that of the larger of the two magnitudes $\phi_M$ and $\phi_S$. Let us explain this in greater detail by referring to FIG. 9, which shows the case where $$\phi_M = 1.0\ [P.U], \text{ and}$$
$$\phi_S = \phi_M \cdot \cos 30^\circ$$
$$= 3^{\frac{1}{2}}/2\ [P.U].$$

Then, from equations (1) through (6), it follows that $$|\phi_{aU}| = |\phi_{Ub}| = |\phi_{bV}| = |\phi_{Vc}| = |\phi_{cW}|$$
$$= (\phi_M^2 + \phi_S^2 - 2\phi_M\phi_S \cos 30^\circ)^{\frac{1}{2}}$$
$$= \{1 + \tfrac{3}{4} - 2\,(3^{\frac{1}{2}}/2)^2\}^{\frac{1}{2}}[P.U].$$
$$= 0.5\ [P.U].$$

Thus, according to the principle of this invention, provided that the ratio of the magnitudes $\phi_M$ and $\phi_S$ of the main magnetic fluxes of the main transformer unit 1 and the series transformer unit 11 are set at appropriate levels, the magnitudes of the differential magnetic fluxes passing through the interphase portions 34 of the core 31 can be reduced to about one half of the larger of the two magnitudes $\phi_M$ and $\phi_S$, with the result that the cross-sectional area of the interphase portions 34 of the core 31 can be reduced to about one half of that of the main leg portions 33.

While description has been made of the particular embodiments of this invention, it will be understood that many modifications may be made without departing from the spirit thereof. For example, it would be evident to those skilled in the art that the principle of this invention is applicable to core-type, as well as shell-type, transformers. Further, the arrangement or ordering of the phase-windings and their winding directions may take forms other than that shown in FIG. 7, provided that the phase angle separations between the main magnetic fluxes passing through any two adjacent magnetic circuits within the core are equal to 30 degrees. Still further, the taps may be provided on the secondary winding 3 of the main transformer 1, wherein the side of the main transformer 1 is provided with the onload voltage regulator. The appended claims are contemplated to cover any such modifications as fall within the true spirit and scope of this invention.

What is claimed is:

1. A phase-shifting transformer comprising:

a six-phase magnetic core including six mutually independent magnetic circuits, first through sixth, through which six mutually independent magnetic fluxes may pass, any two adjacent numbered circuits being geometrically adjacent to each other, wherein any two adjacent magnetic circuits each comprises an interphase portion that is common to both magnetic circuits;

three-phase main transformer windings wound on said six-phase magnetic core and including a three-phase primary winding having three inputs for receiving three-phase input voltages wherein respective phase-windings of said three-phase main transformer windings link with the first, third, and fifth, respectively, of the six magnetic circuits of said six-phase magnetic core, and wherein the windings of the third magnetic circuit are reversed in winding direction with respect to the first and fifth magnetic circuits, whereby, when three-phase input voltages whose phases are displaced by 120 degrees from each other are applied to the three inputs, three magnetic fluxes whose phases are separated from each other by 60 degrees are generated in the first, third, and fifth magnetic circuits; and three-phase series transformer windings wound on said six-phase magnetic core and electrically coupled to said main three-phase transformer windings, the respective phase-windings of the three-phase series transformer windings linking with the second, fourth, and sixth of the six magnetic circuits of said six-phase magnetic core whereby when the three-phase input voltages are applied to the three inputs, three magnetic fluxes are generated in the second, fourth, and sixth magnetic circuits, respectively, whose phases are separated by 60 degrees from each other and by 30 degrees from the phases of the magnetic fluxes generated in adjacent magnetic circuits, whereby the differential magnetic fluxes passing through said interphase portions of said six-phase magnetic core each consist of a vector difference between two magnetic fluxes whose phases are separated by 30 degrees from each other.

2. A phase-shifting transformer comprising:

a six-phase magnetic core including six mutually independent magnetic circuits, first through sixth, through which six mutually independent magnetic fluxes may pass, any two adjacent numbered circuits being geometrically adjacent to each other, wherein any two adjacent magnetic circuits comprises an interphase portion that is common to both magnetic circuits;

a three-phase primary winding having three phase-windings linking with the first, third, and fifth, respectively, of the six magnetic circuits of the six-phase magnetic core and having three inputs for receiving three-phase input voltages, the third magnetic circuit including a phase-winding having a winding direction reversed with respect to winding directions of phase-windings linking with the first and fifth magnetic circuits whereby when three-phase input voltages whose phases are displaced by 120 degrees from each other are applied to the three inputs, three magnetic fluxes whose phases are separated by 60 degrees from each other are generated in the first, third, and fifth magnetic circuits;

a three-phase secondary winding having three phase-windings linking with the first, third, and fifth, respectively, of the six magnetic circuits of the six-phase magnetic core and having three output terminals;

a three-phase tertiary winding having three phase-windings linking with the first, third, and fifth, respectively, of the six magnetic circuits of the six-phase magnetic core, the three phase-windings being electrically coupled in a delta configuration;

a three-phase excitation winding having three phase-windings linking with the second, fourth, and six, respectively, of the six magnetic circuits of the six-phase magnetic core, said three-phase excitation winding being wound on the magnetic core, electrically coupled in a Y configuration, and electrically coupled to said three-phase tertiary winding, whereby when three-phase input voltages whose phases are displaced by 120 degrees from each other are applied to the three inputs, three magnetic fluxes are generated in the second, fourth, and sixth magnetic circuits, respectively, which are separated by 60 degrees from each other and by 30 degrees from the phases of the magnetic fluxes generated by the three phase-windings of said three-phase primary winding in adjacent magnetic circuits, whereby the differential magnetic fluxes passing through said interphase portions of said six-phase magnetic core each consists of a vector difference between two magnetic fluxes of the magnetic circuits to which the interphase portions are common whose phases are separated by 30 degrees from each other; and a three-phase phase-regulating winding having three phase-windings linking with second, fourth, and sixth, respectively, of the six magnetic circuits of the six-phase magnetic core and magnetically coupled with the respective three phase-windings of said three-phase excitation winding via the second, fourth, and sixth magnetic circuits, respectively, wherein the three phase-windings of said three-phase phase-regulating winding are electrically coupled in series with the three phase-windings of said three-phase secondary winding.

3. A phase-shifting transformer as claimed in claim 2 wherein said three-phase phase-regulating winding includes tap means for changing lengths of the three phase-windings of the phase-regulating winding, whereby phase angles of three-phase output voltages supplied at three terminals of said three-phase secondary winding are varied and adjusted arbitrarily by changing the lengths of the three-phase windings that are electrically coupled in series with the three phase-windings of the three-phase secondary winding.

4. A phase-shifting transformer as claimed in claim 2, further comprising a three-phase stabilizing winding having three phase windings linking with the second, fourth, and sixth, respectively, of the six magnetic circuits of the six-phase magnetic core.

5. A phase-shifting transformer as claimed in claim 2, wherein the three phase-windings of said three-phase primary and secondary windings and those of said three-phase excitation winding and of the three-phase phase-regulating winding are Y-connected, while the three phase-windings of said three-phase tertiary winding are Δ-connected.

* * * * *